US008862008B2

(12) United States Patent
Namikata

(10) Patent No.: US 8,862,008 B2
(45) Date of Patent: Oct. 14, 2014

(54) IMAGE PROCESSING APPARATUS, IMAGE PROCESSING METHOD, AND STORAGE MEDIUM

(71) Applicant: Cannon Kabushiki Kaisha, Tokyo (JP)

(72) Inventor: Takeshi Namikata, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 99 days.

(21) Appl. No.: 13/625,534

(22) Filed: Sep. 24, 2012

(65) Prior Publication Data

US 2013/0084093 A1 Apr. 4, 2013

(30) Foreign Application Priority Data

Sep. 30, 2011 (JP) ..... 2011-216777

(51) Int. Cl.
*G03G 15/20* (2006.01)
*G03G 15/00* (2006.01)

(52) U.S. Cl.
CPC ..... *G03G 15/205* (2013.01)
USPC ..... 399/69; 399/82

(58) Field of Classification Search
USPC ..... 399/69, 67, 82
See application file for complete search history.

(56) References Cited

U.S. PATENT DOCUMENTS

2003/0235421 A1* 12/2003 Hooper et al. ..... 399/69
2005/0265742 A1* 12/2005 Kwon ..... 399/69
2012/0315060 A1* 12/2012 Sugiyama et al. ..... 399/69
2013/0084087 A1* 4/2013 Ikeda ..... 399/69 X
2013/0084092 A1* 4/2013 Ooyanagi ..... 399/69

FOREIGN PATENT DOCUMENTS

JP 2009-151102 A 7/2009

OTHER PUBLICATIONS

Machine translation of JP 2009-151102 printed on Feb. 24, 2014.*

* cited by examiner

*Primary Examiner* — Sophia S Chen
(74) *Attorney, Agent, or Firm* — Canon U.S.A., Inc. IP Division

(57) ABSTRACT

An image processing apparatus configured to control a fixing temperature of a fixing device that fixes a formed image includes a fixing temperature control unit configured to control, based on a change amount between a toner amount of an N-th page, where N is a natural number, and a toner amount of an (N+1)th page in a print job having a plurality of pages, a fixing temperature for the (N+1)th page, and a toner amount control unit configured to control the toner amount of the (N+1)th page to be less than or equal to a toner amount which can be fixed at the fixing temperature controlled by the fixing temperature control unit.

10 Claims, 8 Drawing Sheets

FIG.3

| | MAXIMUM TONER AMOUNT | FIXING TEMPERATURE |
|---|---|---|
| FULL-COLOR PRINTING MODE | 240% | T1 |
| UCR PRINTING MODE | 180% | T2 |
| TONER SAVING MODE | 120% | T3 |
| MONOCHROMATIC PRINTING MODE | 100% | T4 |

IMAGE PROCESSING APPARATUS, IMAGE PROCESSING METHOD, AND STORAGE MEDIUM

BACKGROUND OF THE INVENTION

1. Field of the Invention

The present invention relates to an image processing apparatus which controls a fixing temperature of a fixing device in fixing, on a recording sheet, a toner image formed employing an electrophotographic method, and relates to an image processing method thereof and a storage medium.

2. Description of the Related Art

An image forming apparatus which heat-fixes, on the recording sheet, the toner image formed employing the electrophotographic method, determines the fixing temperature of the fixing device according to an amount of color material per unit area to be applied to the recording sheet. Normally, a maximum value of the amount of color material per unit area is predetermined. The image forming apparatus thus adjusts the fixing temperature so that an image formed using such maximum amount of color material can be steadily fixed on the recording sheet.

A full-color copying machine superimposes a plurality of color materials, i.e., cyan (C), magenta (M), yellow (Y), and black (B) color materials, to form the image. The amount of color material (hereinafter referred to as a toner amount) applied to the recording sheet thus tends to increase, and heat capacity of a fixing roller becomes large. If the temperature of the fixing device is lower than the preset temperature, such as when the full-color copying machine is switched on, or is recovering from a sleep state, a fixing warm-up time for the temperature to rise to the preset temperature becomes long. As a result, a print-start waiting time is required in the full-color copying machine. Further, the full-color copying machine may output an image whose toner amount is much smaller than the assumed maximum value. For example, when the full-color copying machine outputs an image in a monochromatic printing mode which only uses the black (K) color material, the full-color copying machine applies excessive heat, so that power is wasted.

To reduce the above-described power consumption, Japanese Patent Application Laid-Open No. 2009-151102 discusses a setting that, when a power saving mode is designated, the fixing temperature of the fixing device is set according to a power-saving setting value. A toner application amount value which can be fixed at the set fixing temperature is then calculated, and image processing is performed according to the calculated toner application amount value.

However, the technique discussed in Japanese Patent Application Laid-Open No. 2009-151102 reduces the toner application amount in all pages included in a print job. If the print job includes a number of pages having portions of high toner density, image quality deterioration increases.

SUMMARY OF THE INVENTION

The present invention is directed to an image processing apparatus capable of reducing a change in the fixing temperatures between pages and reducing image quality deterioration, by referring to the fixing temperatures corresponding to previous and subsequent pages of the page whose pixel values are to be controlled, and by controlling the fixing temperature and the pixel values of the page to be controlled.

According to an aspect of the present invention, an image processing apparatus configured to control a fixing temperature of a fixing device that fixes a formed image, includes a fixing temperature control unit configured to control, based on a change amount between a toner amount of an N-th page, where N is a natural number, and a toner amount of an (N+1)th page in a print job having a plurality of pages, a fixing temperature for the (N+1)th page, and a toner amount control unit configured to control the toner amount of the (N+1)th page to be less than or equal to a toner amount which can be fixed at the fixing temperature controlled by the fixing temperature control unit.

According to an exemplary embodiment of the present invention, the fixing temperature is controlled by referring to the previous and subsequent pages of a target page, so that the change in the fixing temperatures between pages can be reduced.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 3 is a table illustrating a relation among a mode, the toner amount, and the temperature according to the first exemplary embodiment of the present invention.

DESCRIPTION OF THE EMBODIMENTS

Various exemplary embodiments, features, and aspects of the invention will be described in detail below with reference to the drawings.

Figure 1:
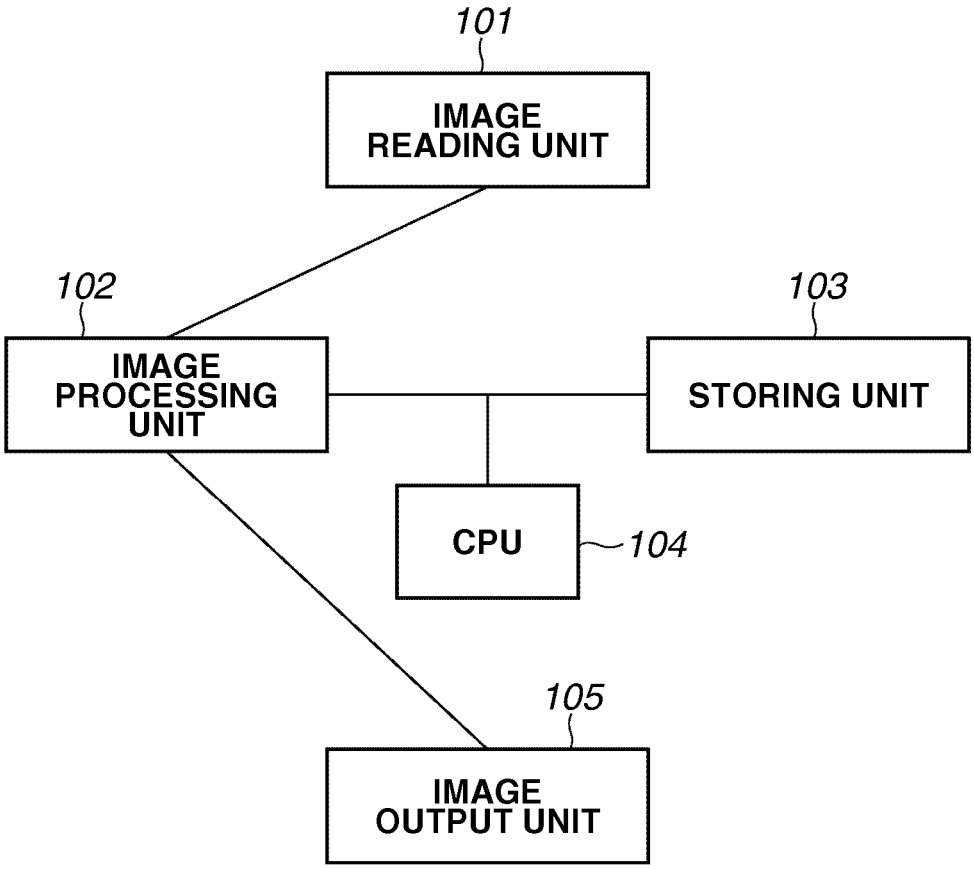
FIG. 1 is a block diagram illustrating a schematic configuration of an image forming apparatus according to a first exemplary embodiment of the present invention.

FIG. 1 is a block diagram illustrating the configuration of the image forming apparatus according to the first exemplary embodiment of the present invention.

Referring to FIG. 1, the image forming apparatus includes an image reading unit 101, an image processing unit 102, a storing unit 103, a central processing unit (CPU) 104, and an image output unit 105. The image forming apparatus may be connectable via a network to a server which manages image data, and a personal computer (PC) which instructs printing. Further, an apparatus including the image processing unit 102, the storing unit 103, and the CPU 104 will be referred to as an image processing apparatus.

The image reading unit 101 reads an image of a document and outputs the image data.

The image processing unit 102 inputs the print job from the image reading unit 101 or an external device. The image processing unit 102 then converts print information including the image data in the print job to intermediate information (hereinafter referred to as an object), and stores the object in an object buffer in the storing unit 103. Further, the image processing unit 102 generates bitmap data based on the buffered object, and stores the bitmap data in the buffer in the storing unit 103. In such a case, the image processing unit 102 performs color conversion, image adjustment, and total toner amount control, which will be described in detail below.

The storing unit 103 includes a read-only memory (ROM), a random access memory (RAM), and a hard disk (HD). The ROM stores various control programs and image processing programs executed by the CPU 104. The RAM is used as a reference area or a work area in which the CPU 104 stores the data and various types of information. Further, the RAM and the HD are used to store the above-described object buffer and a fixing temperature setting value to be described below. The image forming apparatus stores the image data in the RAM and the HD, sorts the pages, stores the document including a plurality of the sorted pages, and prints a plurality of copies.

The image output unit 105 forms the color image on a recording medium such as the recording sheet and outputs the color image.

Figure 2:
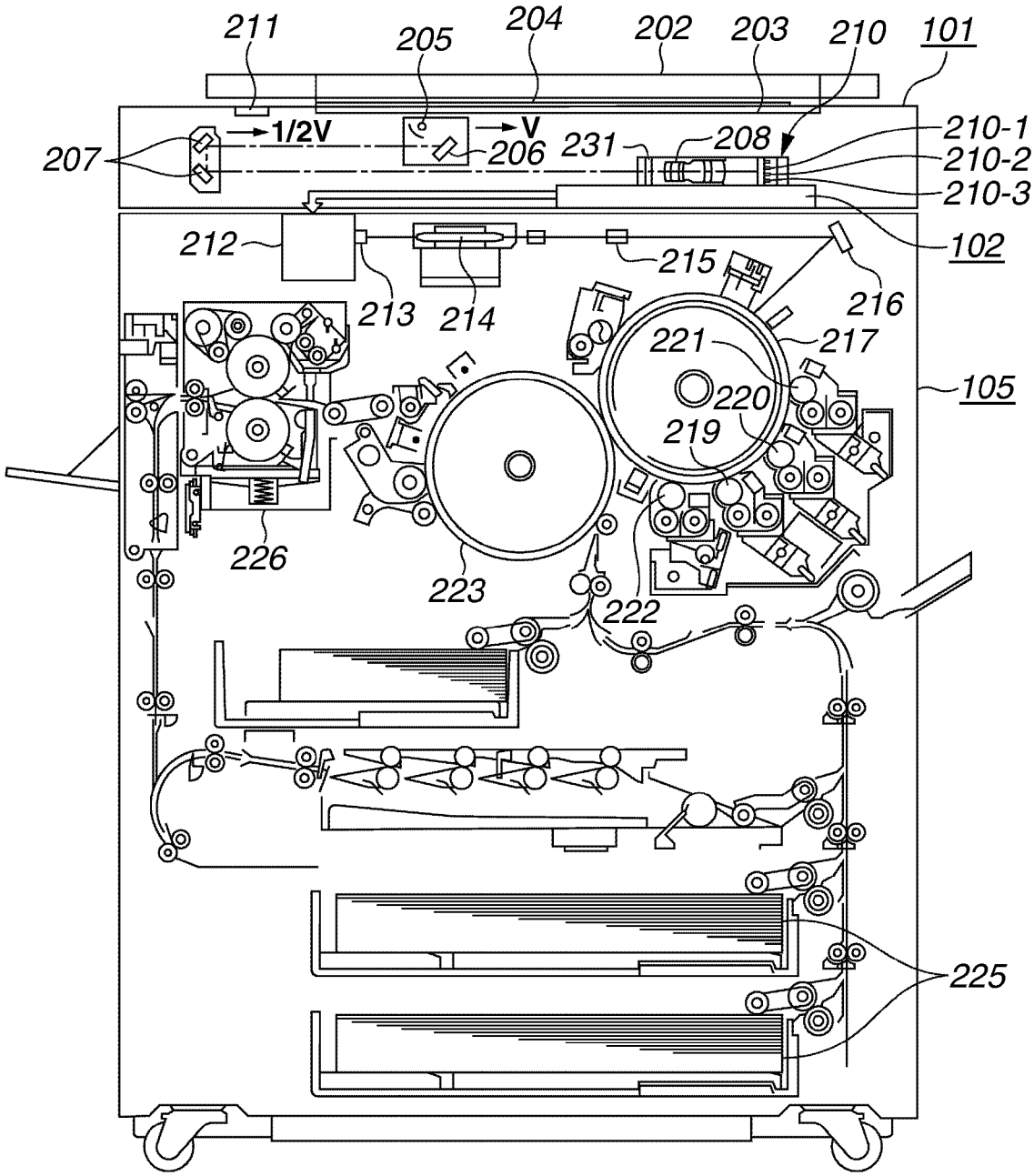
FIG. 2 is a schematic diagram of the image forming apparatus according to the first exemplary embodiment of the present invention.

FIG. 2 is a schematic diagram illustrating the image forming apparatus illustrated in FIG. 1.

Referring to FIG. 2, a document 204 whose image is to be read is placed between a document positioning glass plate 203 and a document pressing plate 202 in the image reading unit 101, and is irradiated with light by a lamp 205. Reflected light from the document 204 is then guided to mirrors 206 and 207, and a lens 208 forms the image on a three-line sensor 210. An infrared cutoff filter 231 is disposed on the lens 208. A motor (not illustrated) moves, in a direction indicated by arrows illustrated in FIG. 2, a mirror unit including the mirror 206 and the lamp 205 at a speed V, and a mirror unit including the mirror 207 at a speed V/2. In other words, the mirror units are moved in a perpendicular direction (i.e., a sub-scanning direction) with respect to an electrical scanning direction (i.e., a main scanning direction) of the three-line sensor 210, and scan an entire surface of the document 204.

The three-line sensor 210 including three lines of a charge-coupled device (CCD) performs color separation on input light information, and reads each of color components, i.e., red (R), green (G), and blue (B) of full color information. The three-line sensor 210 then transmits color component signals of the read color components to the image processing unit 102. Each of the CCDs in the three-line sensor 210 includes light-receiving units corresponding to 5000 pixels. The CCDs are thus capable of reading an A3 size document, which is a maximum size of the document placeable on the document positioning glass plate 203, in a lateral direction (i.e., 297 mm) at a resolution of 600 dpi.

A standard white plate 211 is used to correct the data read by each of the CCD 210-1, CCD 210-2, and CCD 210-3 in the three-line sensor 210. The standard white plate 211 is of a white color which has an almost uniform reflectivity with respect to visible light.

The image processing unit 102 electrically processes the image signals input from the three-line sensor 210, generates each of C, M, Y, and K color component signals, and transmits the generated C, M, Y, and K color component signals to the image output unit 105. In such a case, the output image is a CMYK image on which halftone processing such as dither processing has been performed.

The image output unit 105 transmits the C, M, Y, or K image signal received from the image reading unit 101, to a laser driver 212. The laser driver 212 performs modulation driving of a semiconductor laser element 213 according to the input image signal. The semiconductor laser element 213 then outputs a laser beam which scans a photosensitive drum 217 via a polygon mirror 214, an f–θ lens 215, and a mirror 216, and forms an electrostatic latent image on the photosensitive drum 217.

The developing device includes a magenta developing device 219, a cyan developing device 220, a yellow developing device 221, and a black developing device 222. The four developing devices alternately contact the photosensitive drum 217 to develop the electrostatic latent image formed on the photosensitive drum 217 using toners of the corresponding color, and form the toner image. A recording sheet cassette 225 supplies the recording sheet, which is then wound around a transfer drum 223, and the toner image formed on the photosensitive drum 217 is transferred to the recording sheet.

The recording sheet on which the C, M, Y, and K toner images are sequentially transferred as described above passes through a fixing unit 226. The fixing unit 226 thus fixes the toner image on the recording sheet, and the recording sheet is discharged to outside the apparatus. The fixing unit 226 applies a pressing force and heat from an internal pressing roller to the recording sheet on which the toner image is transferred, to fix the C, M, Y, and K toner images on the recording sheet. In such a case, if a heat amount is insufficient with respect to the toner amount, a fixing failure occurs, and a normal image cannot be acquired. To prevent such a problem, a temperature sensor (not illustrated) is attached to the fixing unit 226, and the fixing unit 226 is controlled to perform the fixing process only when a sufficient temperature for fixing the image is confirmed. The CPU 104 performs such temperature control based on a relation between temperature sensor information and the toner amount.

A relation between a print mode and the temperature necessary for the fixing unit, which is associated with the above-described toner amount, will be described below.

The toner amount indicates an amount of toner per unit area in the image, and will be described below in percent (%) figures. More specifically, if the maximum value of each of the C, M, Y, and K colors is set as 100%, and two colors are superimposed at the maximum values, the toner amount of such an area is defined as 200%. Since each color has a gradation, the toner amount may be of values between 0% to 100%.

The maximum value of the toner amount is different for each printing mode. Features and the maximum toner amounts of four printing modes will be described below.

In a full-color printing mode, the image forming apparatus uses the four color toners, i.e., C, M, Y, and K toners, reproduces an arbitrary color to an extent that can be reproduced using such toners, and performs high-quality color printing. A maximum toner amount of 240% is sufficient in the full-color printing mode.

In an under color removal (UCR) printing mode, the image forming apparatus replaces a black or a gray color reproduced in the full-color mode with three colors, i.e., C, M, and Y, by a single color, i.e., K. The UCR printing mode thus prevents toner from spattering when printing characters and thin lines, and improves readability of printed text. Since the C, M, and Y toners are replaced by the K toner, the maximum toner amount decreases. The maximum toner amount in the UCR printing mode is set to 180%.

In a toner saving mode, the image forming apparatus prints paler images as compared to the image printed in the full-color printing mode, so that the toner amounts to be used are decreased. The amount of consumed toner becomes half of that in the full-color printing mode, so that the maximum toner amount becomes 120%, i.e., half of the maximum toner amount in the full-color printing mode.

In the monochromatic printing mode, the image forming apparatus uses only one color toner as in monochrome printing. The maximum toner amount becomes 100%, i.e., the maximum value for one color.

As described above, the maximum toner amount is different for each of the four printing modes. The temperature of the fixing unit necessary for each mode is thus different, and the necessary temperature rises as the maximum toner amount increases. If it is assumed that the fixing temperature in the full-color printing mode is T1, in the UCR printing mode is T2, in the toner saving mode is T3, and in the monochromatic printing mode is T4, the relation becomes T1>T2>T3>T4. FIG. 3 illustrates such a relation. The table illustrated in FIG. 3 is used in performing control, and is thus stored in the RAM area in the storing unit 103.

Further, the information on each of the printing modes is attached as attribute information to each page in the print job. The printing mode for each page may be specified by a user using an operation unit in the image forming apparatus, or may be determined according to image content for each page. For example, the image forming apparatus determines whether the page includes a color image or is monochrome. If the image forming apparatus determines that the image includes a color, the image forming apparatus adds the full-color printing mode as the attribute to the page. If the image is monochrome, the image forming apparatus adds the monochromatic printing mode as the attribute to the page.

Figure 4:
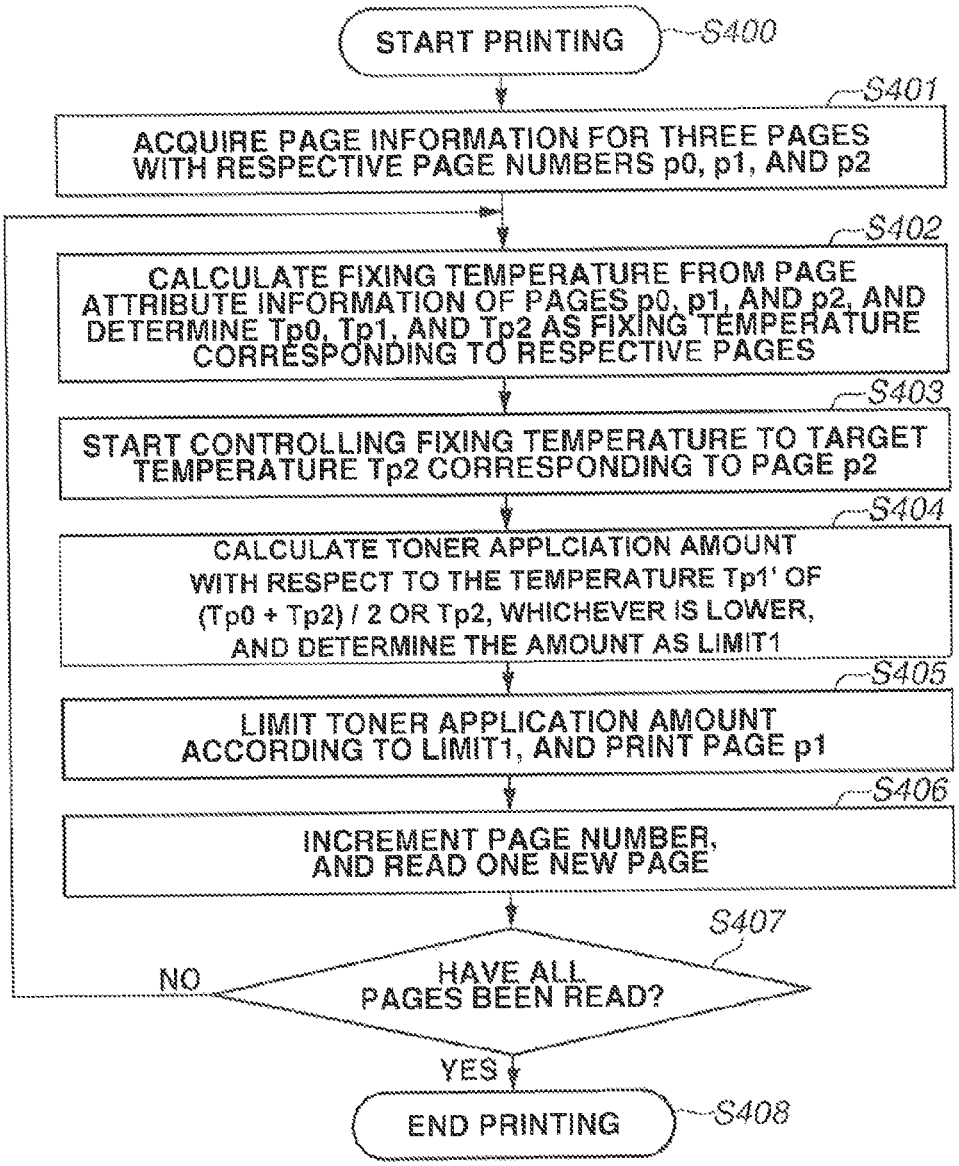
FIG. 4 is a flowchart illustrating a process performed according to the first exemplary embodiment of the present invention.

FIG. 4 is a flowchart of a process performed according to the present exemplary embodiment. The processes illustrated in the flowcharts to be described below are performed by the CPU 104 executing the programs, and the image processing unit 102 operating according to an instruction from the CPU 104.

The processing flow illustrated in FIG. 4 may be performed only when a power saving mode or an energy saving mode is selected. When such a mode is not selected, the fixing temperature may be set for each page by reference to the attribute information of each page and the table illustrated in FIG. 3.

In step S400, the CPU 104 receives from the image reading unit 101 or the external device such as the PC, the print job including a plurality of pages, and starts performing printing. In step S401, upon starting printing, the CPU 104 acquires from the print job, the information corresponding to three pages having page numbers p0, p1, and p2, and determines the print mode for each page. If the print job is to copy the current document, the CPU 104 determines a mode from among the four modes according to the setting input to the operation unit. If the print job is to print, the CPU 104 determines a mode according to the setting from a printer driver.

The page number of the page currently being processed is p0 (i.e., a first page). Further, page numbers of the pages acquired by reading ahead the subsequent page and the page after the subsequent page are p1 (i.e., a second page) and p2 (i.e., a third page), respectively. In other words, according to the present exemplary embodiment, it is not necessary to acquire the information on the entire print job to realize the process. For example, the process can be realized by performing control based on the information on the subsequent page and the page after the subsequent page.

In step S402, the CPU 104 refers to the above-described table illustrated in FIG. 3 stored in the storing unit 103, and determines the fixing temperature corresponding to the printing mode for each page determined in step S401. For example, the CPU 104 determines the fixing temperature corresponding to the printing mode of page p0 as Tp0, the fixing temperature corresponding to the printing mode of page p1 as Tp1, and the fixing temperature corresponding to the printing mode of page p2 as Tp2.

In step S401, the CPU 104 may determine the maximum toner amount for each page by analyzing the content of the page instead of determining the printing mode for each page. In such a case, in step S402, the CPU 104 refers to the above-described table illustrated in FIG. 3 stored in the storing unit 103 and determines the fixing temperature corresponding to the maximum toner amount for each page determined in step S401.

In step S403, the CPU 104 instructs the fixing unit 226 to control the temperature to target the fixing temperature Tp2 corresponding to page p2, i.e., the page after the subsequent page of page p0. The CPU 104 then starts controlling the fixing temperature. The temperature is controlled to target the fixing temperature corresponding to the page after the subsequent page instead of the subsequent page, so that the fixing temperature of the target page is not drastically raised or lowered. This can prevent power, for rapidly raising the temperature, from being consumed.

In step S404, the CPU 104 calculates, at the same time as the fixing unit 226 controls the temperature, an application amount limit value to be used in limiting the amount of the toner applied in page p1, i.e., the subsequent page of page p0. More specifically, the CPU 104 calculates an average value between the fixing temperature Tp0 required by the current page p0 and the fixing temperature Tp2 required by the page after the subsequent page p2. The CPU 104 then compares the calculated average value with Tp1, and sets the lower temperature as a fixing temperature Tp1' of page p1. In other words, the CPU 104 changes the fixing temperature of page p1 from Tp1 to Tp1'. The CPU 104 thus calculates a limit value LIMIT1 (%) of the toner amount corresponding to the new fixing temperature Tp1' by inversely looking up a look-up-table (LUT) such as a graph illustrated in FIG. 6.

If the fixing temperatures of page p0 and page p2 are lower, and the fixing temperature of page p1 is higher, the change in the fixing temperatures between pages can be reduced by lowering the fixing temperature of page p1. The application amount limit value of page p1 is thus also decreased by lowering the fixing temperature of page p1.

The fixing temperature Tp1' for page p1 may be determined based on the amount of change between the toner amount corresponding to the print mode for page p1 and the toner amount corresponding to the print mode for page p0. Specifically, in a case where a value obtained by subtracting the toner amount of page p0 from the toner amount of page p1 is greater than or equal to a predetermined value, the fixing temperature Tp1' for page p1 is set to a temperature close to the fixing temperature for page p0. The limit value LIMIT1 (%) of the toner amount corresponding to the fixing temperature Tp1' is determined by reference to the graph illustrated FIG. 6, as described above.

The relation between the toner amount, the printing mode, and the necessary temperature for the fixing unit 226 will be described below with reference to FIG. 6.

The toner amount indicates the amount of toner per unit area in the image. Further, it is necessary to set the temperature of the fixing unit 226 so that the fixing unit 226 is capable of fixing the image including a maximum amount of toner, to assure that the fixing unit 226 can constantly fix the image on the recording sheet. As described above, according to the first exemplary embodiment, since the maximum toner amount is different for each printing mode, the temperature of the fixing unit necessary for each case is different, and the necessary temperature becomes higher as the maximum toner amount increases.

However, if the maximum toner amount is 0, i.e., the document is a blank sheet, it is not necessary to set the fixing temperature. Further, if there is no pixel exceeding the maximum toner amount of 180% in the full-color printing mode, it is not necessary to set the fixing temperature above T2 illustrated in FIG. 6.

Figure 6:
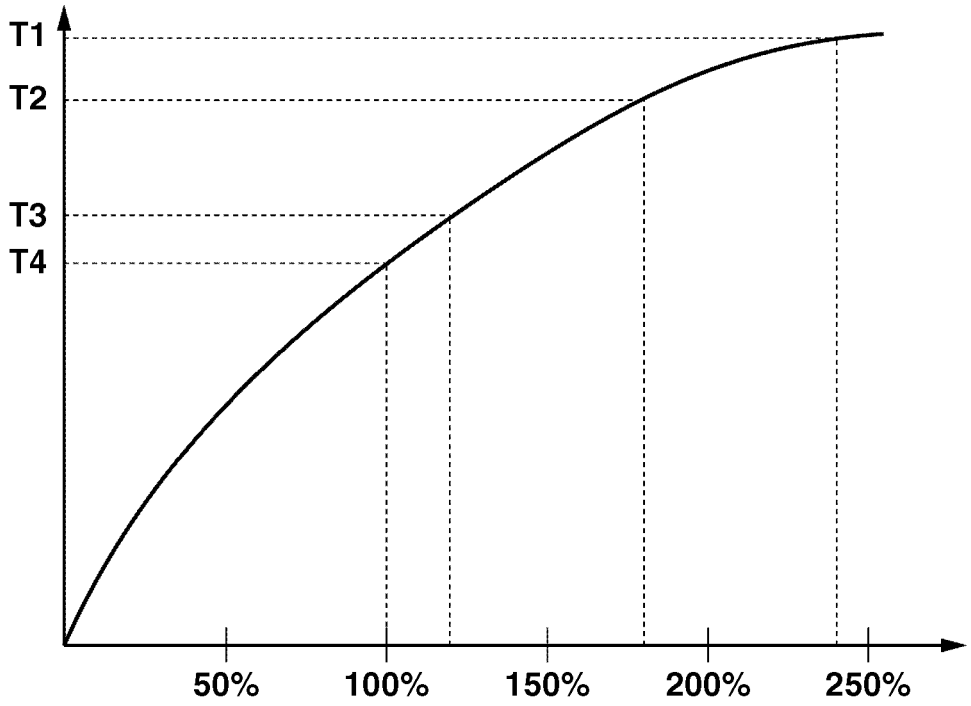
FIG. 6 is a table illustrating the relation between the toner amount and the temperature according to a second exemplary embodiment of the present invention.

Furthermore, the actual relation between the maximum toner amount and the fixing temperature is not discretely-distributed as illustrated in FIG. 3, but is continuously changing as illustrated in FIG. 6. The minimal temperature necessary for fixing the image can thus be acquired by calculating an appropriate fixing temperature based on the image data using the relation illustrated in FIG. 6. If the fixing temperature rises so that the maximum toner amount in the image can be fixed, the fixing failure will not occur in the entire image. Since the relation illustrated in FIG. 6 is used in performing control, the relation in a form of the LUT is stored in the RAM area in the storing unit 103.

In step S405 illustrated in FIG. 4, the CPU 104 instructs the image processing unit 102 to perform color conversion for performing printing and the application amount limiting process according to the limit value LIMIT1, and then perform printing. In other words, in step S405, the image processing unit 102 performs color conversion on the RGB image data corresponding to page p1, and converts the RGB image data to CMYK image data. The image processing unit 102 then minimizes the pixel values of the CMYK image data so that each pixel value becomes less than or equal to the limit value (i.e., LIMIT1).

Figure 5:
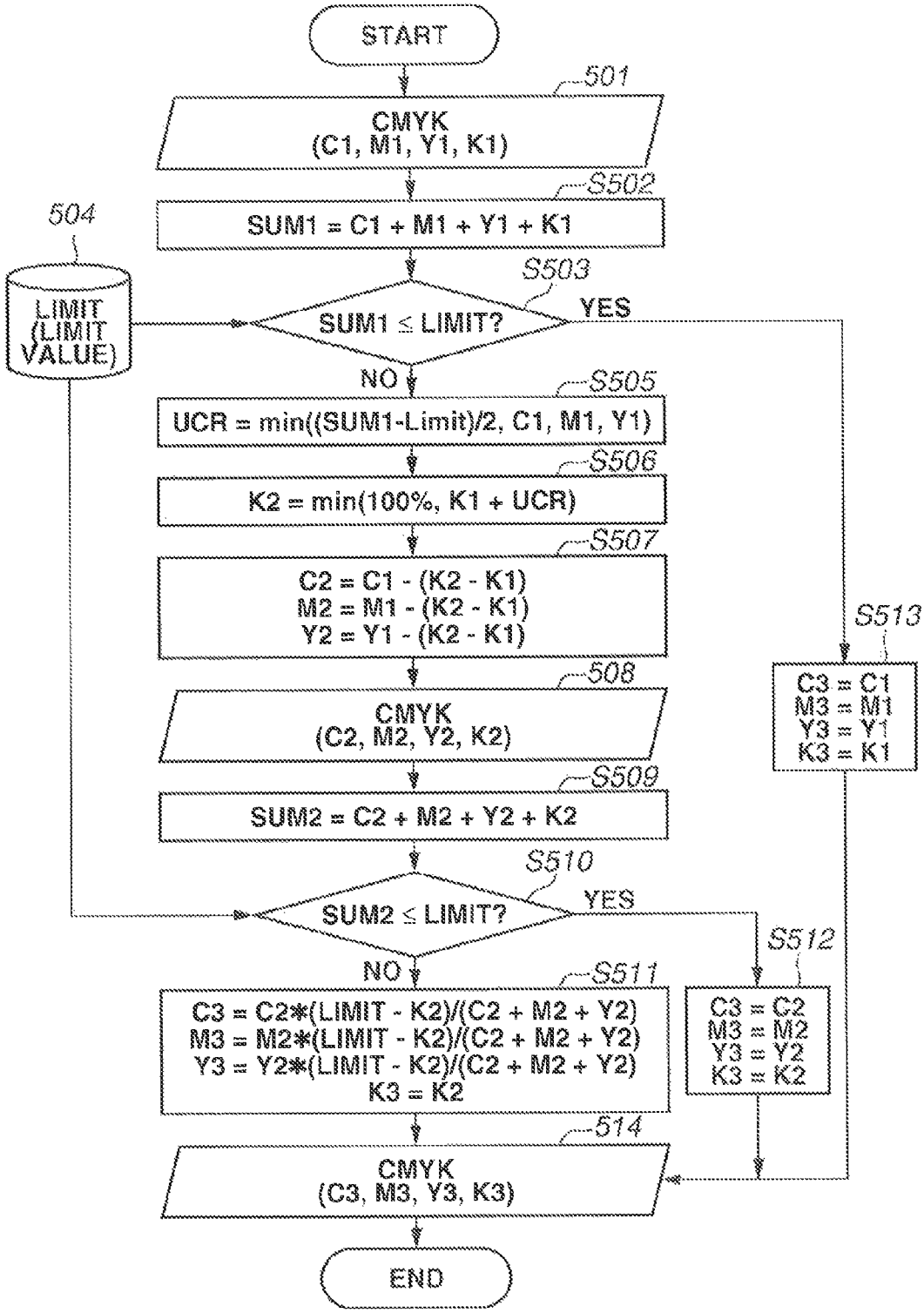
FIG. 5 is a flowchart illustrating a total toner amount control process according to the first exemplary embodiment of the present invention.

The application amount limiting process will be separately described below with reference to FIG. 5.

The color conversion process performed by the image processing unit 102 for converting the image drawn in RGB into CMYK data will be described below. The image processing unit 102 performs table conversion using a conventional three-dimensional LUT. In such a case, the image processing unit 102 switches the color conversion table according to the printing mode determined in step S401.

More specifically, if the printing mode is the full-color printing mode, the image processing unit 102 converts the RGB values of each pixel to the corresponding CMYK data. If the printing mode is the monochromatic printing mode, the image processing unit 102 converts the RGB values of each pixel to the data including only the K data. In the case of the UCR printing mode, the image processing unit 102 converts a gray pixel in which R=G=B to only the K data in which C=M=Y=0, and other pixels to the CMYK data corresponding to the RGB values. In the case of the toner saving mode, the image processing unit 102 outputs the values which are reduced to half of the values acquired by converting the RGB values to the CMYK data in the full-color printing mode.

As a result of performing color conversion, the image data indicates the C, M, Y, and K toner amounts, expressed in 8 bit as values between 0 to 255 per pixel. Further, the LUT is adjusted so that a combination of values exceeding the maximum toner amount determined for each printing mode is not output.

More specifically, if the value for each color is 0, the LUT indicates that the toner is unused (i.e., the image is white). The density increases as the values increase, and the maximum density is reached when the pixel value is 255, in which the toner amount is 100%. The value of C+M+Y+K indicates the toner amount of each pixel, and the maximum value thereof corresponding to the toner amount of 400% thus becomes 1020. The LUT is adjusted so that the maximum value for each printing mode is not exceeded. For example, if the maximum value in the full-color printing mode is 240%, the LUT is adjusted so that the value of C+M+Y+K does not exceed 612.

The toner application amount limiting process will be described in detail below with reference to FIG. 5.

The process is performed by referring to all of the C, M, Y, and K colors per pixel. In step S502, the CPU 104 calculates a sum SUM1 with respect to input CMYK (C1, M1, Y1, K1) 501. The CMYK (C1, M1, Y1, K1) 501 is the data per pixel in the CMYK image generated by performing color conversion in step S405 of the flowchart illustrated in FIG. 4.

In step S503, the CPU 104 reads and compares a LIMIT (a limit value) 504 with SUM1. The LIMIT 504 is the limit value of the toner amount that can be fixed, and is defined as a value such as "240%" in the case of the full-color printing mode. According to the present exemplary embodiment, LIMIT 504 indicates the above-described limit value LIMIT1.

If the SUM1 is less than or equal to LIMIT (the limit value) 504 (YES in step S503), the process proceeds to step S513. In step S513, the CPU 104 outputs CMYK (C1, M1, Y1, and K1) 501 as CMYK (C3, M3, Y3, and K3) 514, i.e., the data per pixel in the CMYK image output in the total toner amount control process according to the present exemplary embodiment.

On the other hand, if the SUM1 is greater than LIMIT (the limit value) 504 (NO in step S503), the process proceeds to step S505. In step S505, the CPU 104 calculates a UCR value, which affects reduction values of the C, M, and Y toners and an increase value of the K toner. In the total toner amount control process, the CPU 104 sets, as the UCR value, half of the amount exceeding the limit value, or the smallest value among C1, M1, and Y1, to minimize the reduction value of the toner amount.

In step S506, the image processing unit 102 calculates the value of K2 among the values C2, M2, Y2, and K2 which are acquired after performing a first total toner amount limiting process. The image processing unit 102 basically calculates K2 by adding the UCR value to K1. However, since a value exceeding 100% cannot be set to K2 alone, the value of 100% is set to K2 even if the value exceeds 100%.

In step S507, the image processing unit 102 reduces the values of C1, M1, and Y1, and calculates C2, M2, and Y2. The image processing unit 102 reduces the values of C1, M1, and Y1 by a difference between K2 calculated in step S506 and K1. The image processing unit 102 thus calculates CMYK (C2, M2, Y2, K2) 508 in which the total toner amount is reduced.

In step S509, the image processing unit adds C2, M2, Y2, and K2, and thus calculates SUM2. In step S510, the image processing unit 102 reads the LIMIT (limit value) 504 and compares with SUM2. If SUM2 is less than or equal to the LIMIT (limit value) 504 (YES in step S510), the process proceeds to step S512. In step S512, the image processing unit 102 outputs CMYK (C2, M2, Y2, K2) 508 as CMYK (C3, M3, Y3, K3) 514.

If SUM2 is greater than the LIMIT (limit value) 504 (NO in step S510), the process proceeds to step S511. In step S511, the image processing unit 102 directly sets the value of K2 to K3, and calculates a coefficient from the value acquired by subtracting K2 from the LIMIT (limit value) 504, and the sum of C2, M2, and Y2. The image processing unit 102 then multiplies the calculated coefficient by C2, M2, and Y2, to acquire C3, M3, and Y3 in which the toner amounts are reduced, and outputs CMYK (C3, M3, Y3, K3) 514.

As a result of the above-described process, it is ensured that the sum of C, M, Y, and K, i.e., the total toner amount, becomes less than or equal to the maximum toner amount corresponding to the printing mode. The image can thus be fixed at the fixing temperature determined in step S403 illustrated in FIG. 4.

In step S406 illustrated in FIG. 4, the CPU 104 increments the page by one, so that the subsequent page p1 becomes p0 and the page after the subsequent page p2 becomes p1. The CPU 104 then reads the new page after the subsequent page p2. In step S407, the CPU 104 determines whether all pages have been read. If all pages have been read (YES in step S407), the process proceeds to step S408, and the process ends. If there is a page to read (NO in step S407), the process returns to step S402.

The first, second, and third pages in the print job may be consecutive pages or inconsecutive pages, i.e., pages with predetermined intervals in between.

By performing the above-described process, a drastic change in the fixing temperatures between pages is reduced, and the power consumption of the fixing device can be reduced. Reducing the changes in the fixing temperature can prevent toner from spattering, and can fix the image even at a low fixing temperature, by limiting the pixel value to be the toner application amount which can be fixed by the fixing unit.

According to the first exemplary embodiment, the temperature of the fixing unit is controlled based on the printing mode and the maximum toner amount of the printing mode. However, there are images in which the maximum toner amount is hardly employed in the corresponding printing mode. For example, if the monochrome data is printed in the full-color printing mode, most of the image is printed using only the K toner, so that the toner amount does not exceed 100%. In such a case, if the temperature setting for the full-color printing mode is applied to the fixing unit, the fixing unit becomes overheated. There may thus be unnecessary warm-up waiting time, and power may be wasted.

To solve such a problem, according to the second exemplary embodiment, the temperature of the fixing device is controlled based on the information on the maximum pixel value of each page instead of the information on the printing mode.

Figure 7:
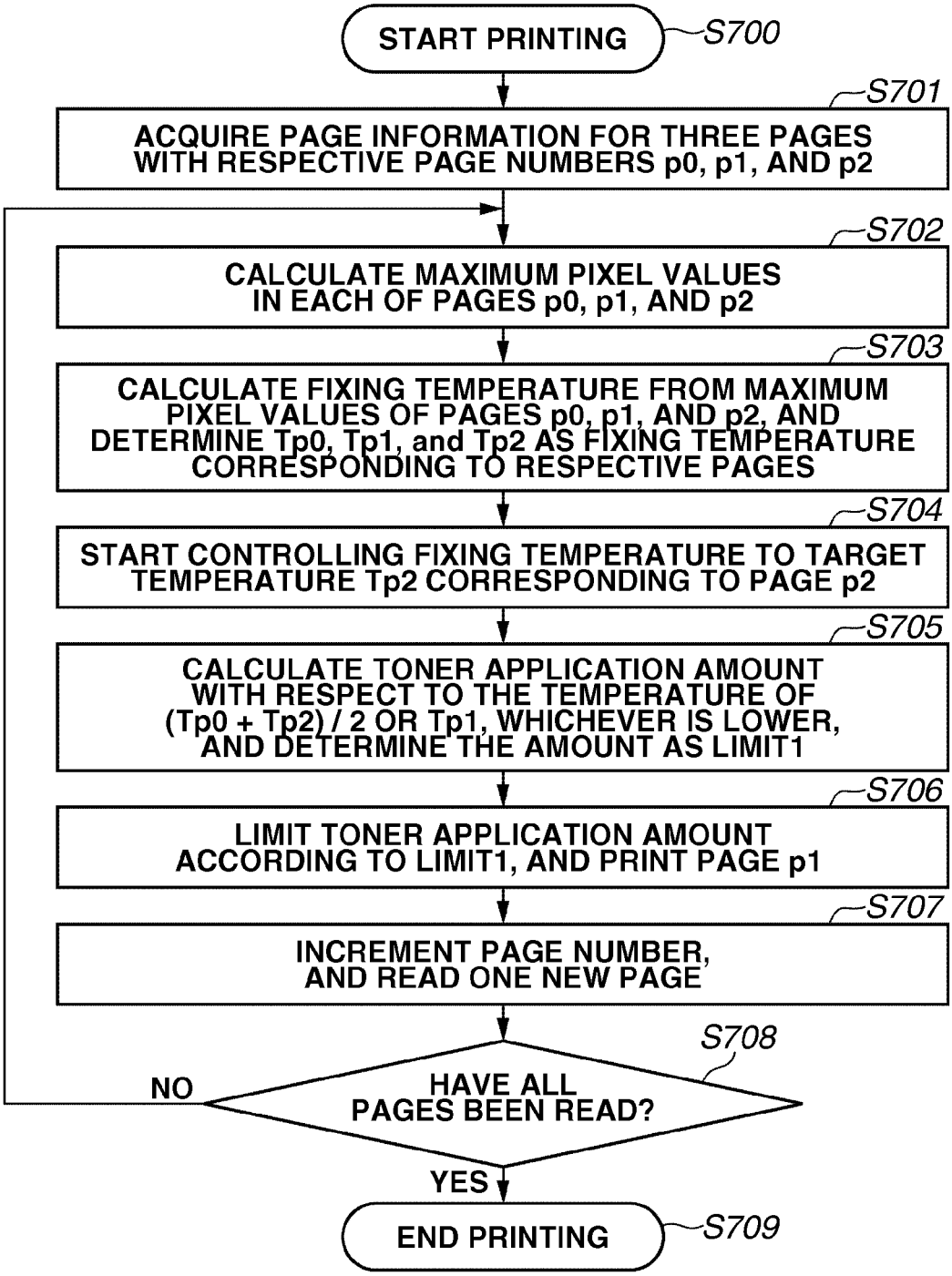
FIG. 7 is a flowchart illustrating a process performed according to the second exemplary embodiment of the present invention.

FIG. 7 is a flowchart illustrating the process performed according to the present exemplary embodiment. Since step S700, step S701, and step S704 to step S709 are the same as, or as an alternative similar to, step S400, step S401, and step S403 to step S408 described above and illustrated in FIG. 4, further description thereof will be omitted.

In step S702, which is unique to the present exemplary embodiment, the CPU 104 acquires the maximum toner application amount in each page, i.e., the maximum value of the sum of the C, M, Y, and K values of each pixel. In step S703, the CPU 104 acquires the fixing temperatures Tp0, Tp1, and Tp2 necessary for fixing the images on pages p0, p1, and p2, from the maximum toner application amount in each page acquired in step S702, using the relation illustrated in FIG. 6. According to the second exemplary embodiment, the maximum toner application amount in each page is added to each page as the attribute information.

The CPU 104 performs the processes of step S704 and thereafter with respect to the fixing temperature acquired in step S703. It thus becomes more likely for the fixing unit to operate at a lower fixing temperature as compared to the first exemplary embodiment, and power consumption can thus be further reduced.

The fixing temperature Tp1' for page p1, which is determined in step S705, may be determined based on the amount of change between the maximum toner application amount of page p1 and the maximum toner application amount of page p0. Specifically, in a case where a value obtained by subtracting the maximum toner application amount of page p0 from the maximum toner application amount of page p1 is greater than or equal to a predetermined value, the fixing temperature Tp1' for page p1 is set to a temperature close to the fixing temperature for page p0. The limit value LIMIT1 (%) of the toner amount corresponding to the fixing temperature Tp1' is determined by reference to the graph illustrated FIG. 6, as described above.

According to the first and second exemplary embodiments, the fixing temperature is adjusted to be the temperature necessary for fixing the page after the subsequent page according to a job pattern (refer to step S403 illustrated in FIG. 4 and step S704 in FIG. 7). In the third exemplary embodiment, if the fixing unit responds at higher speed to temperature adjustment, the temperature is adjusted to target the temperature required for the subsequent page instead of the page after the subsequent page. The application amount limiting process is then performed according to the fixing temperature raised until the page is output.

Figure 8:
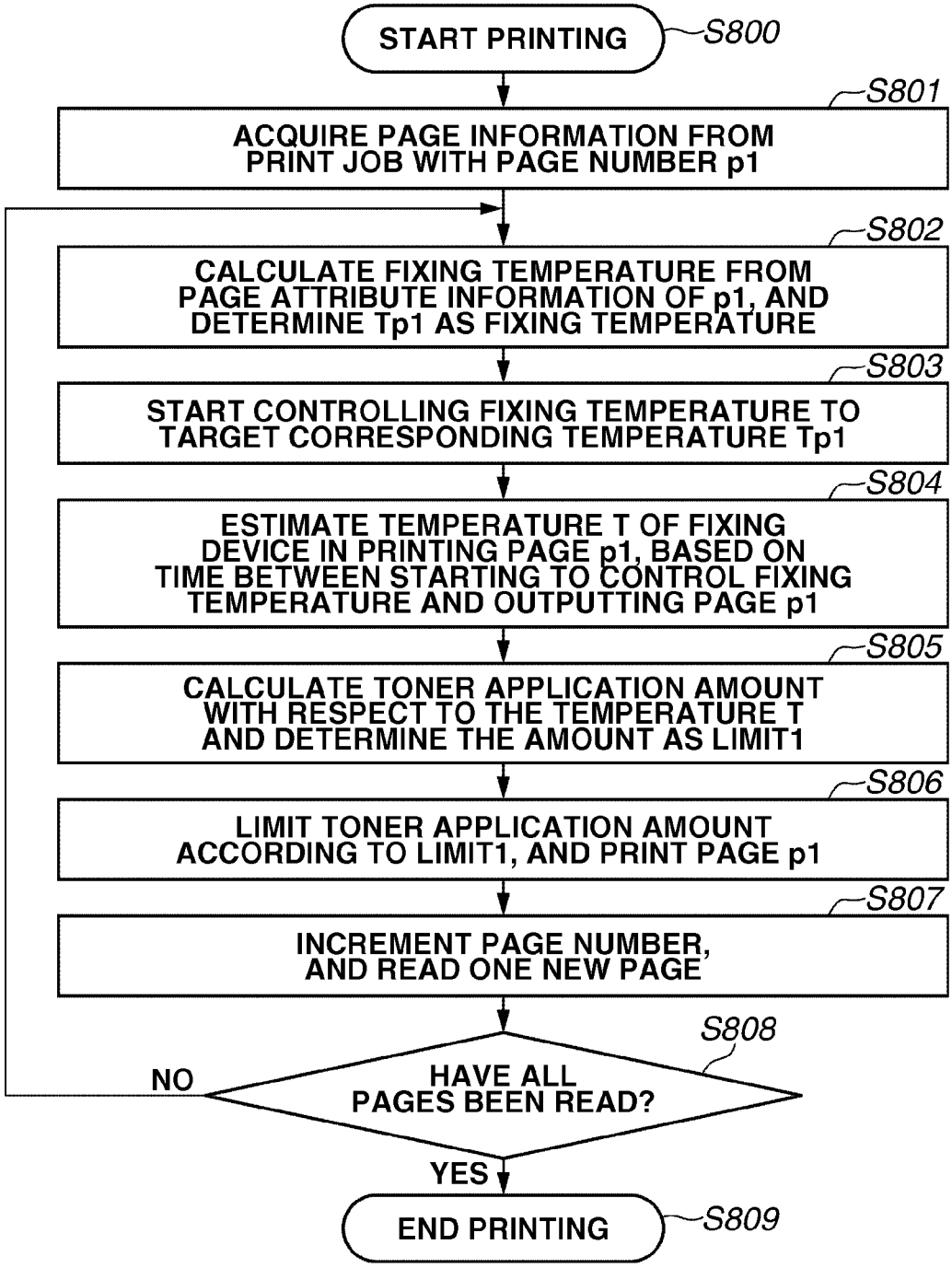
FIG. 8 is a flowchart illustrating a process performed according to a third exemplary embodiment of the present invention.

FIG. 8 is a flowchart illustrating the printing process performed by the CPU 104 according to the present exemplary embodiment.

In step S800, the CPU 104 receives the print job input from the image reading unit 101 or the external device such as the PC and starts printing. In step S801, the CPU 104 acquires, from the print job, the information on the page indicated by the page number p1, and determines the printing mode of the page. If the print job is to copy the current document, the CPU 104 determines a mode from among the four modes according to the setting input to the operation unit. If the print job is to print, the CPU 104 determines a mode according to the setting from the printer driver.

In step S802, the CPU 104 determines the temperature setting necessary for fixing the image in the printing mode determined in step S801. In other words, the CPU 104 determines the temperature necessary for fixing the image in the printing mode by referring to the table illustrated in FIG. 3 stored in the storing unit 103.

In step S803, the CPU 104 instructs the fixing unit 226 to control the temperature to target the fixing temperature Tp1 corresponding to the subsequent page p1. The CPU 104 thus starts controlling the fixing temperature.

In step S804, the CPU 104 estimates the rise in the fixing temperature (i.e., temperature rise) when page p1 is printed, based on the time from starting to control the fixing temperature in step S803 until the subsequent page p1 is actually output from the image output unit 105. The CPU 104 sets the estimated temperature as temperature T. If the fixing temperature of the fixing unit slowly rises, the fixing temperature T does not reach the fixing temperature Tp1 (i.e., T<Tp1) set in step S803 as the target temperature.

In step S805, the CPU 104 calculates the toner application amount limit value corresponding to the temperature T by referring to the LUT illustrated in FIG. 6, and sets the calculated value as LIMIT1.

In step S806, the CPU 104 instructs the image processing unit 102 to perform color conversion necessary for printing, and the toner application amount limit process according to the limit value LIMIT1, and then perform printing. The details of the color conversion process and the toner application amount limit process are as described in the first exemplary embodiment.

In step S807, the CPU 104 reads the subsequent page. In step S808, the CPU 104 determines whether all pages in the job have been read. If all pages have been read (YES in step S808), the process proceeds to step S809, and the process ends.

Aspects of the present invention can also be realized by a computer of a system or apparatus (or devices such as a CPU or a micro-processing unit (MPU) which may also be referred to as a microprocessor) that reads out and executes a program recorded on a memory device to perform the functions of the above-described embodiment(s), and by a method, the steps of which are performed by a computer of a system or apparatus by, for example, reading out and executing a program recorded on a memory device to perform the functions of one or more of the above-described embodiment (s). The program can be provided to the computer for example via a network or from a recording medium of various types serving as the memory device (e.g., non-transitory computer-readable medium). The computer-readable medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-216777 filed Sep. 30, 2011, which is hereby incorporated by reference herein in its entirety.

What is claimed is:

1. An image processing apparatus configured to control a fixing temperature of a fixing device that fixes a formed image, the image processing apparatus comprising:

a fixing temperature control unit configured to control a fixing temperature for the (N+1)th page, based on a change amount between a toner amount of an N-th page, where N is a natural number, and a toner amount of an (N+1)th page in a print job having a plurality of pages, and a toner amount of an (N+2)th page in the print job; and a toner amount control unit configured to control the toner amount of the (N+1)th page to be less than or equal to a toner amount which can be fixed at the fixing temperature controlled by the fixing temperature control unit.

2. The image processing apparatus according to claim 1, wherein, in a case where a value obtained by subtracting the toner amount of the N-th page from the toner amount of the (N+1)th page is greater than or equal to a predetermined value, the fixing temperature control unit sets the fixing temperature for the (N+1)th page to a temperature close to the fixing temperature for the N-th page.

3. The image processing apparatus according to claim 1, wherein the fixing temperature control unit controls, based on a fixing temperature corresponding to the toner amount of the N-th page and a fixing temperature corresponding to the toner amount of the (N+2)th page, a fixing temperature for the (N+1)th page.

4. The image processing apparatus according to claim 1, wherein a toner amount of each page included in the print job having a plurality of pages is determined based on attribute information of each page.

5. The image processing apparatus according to claim 4, wherein the attribute information includes a printing mode.

6. The image processing apparatus according to claim 5, wherein the printing mode includes at least one of a full-color printing mode, an under color removal (UCR) printing mode, a toner saving mode, and a monochromatic printing mode.

7. The image processing apparatus according to claim 1, wherein a toner amount of each page included in the print job having a plurality of pages is calculated by analyzing contents of each page.

8. The image processing apparatus according to claim 1, wherein a toner amount of each page included in the print job having a plurality of pages indicates a maximum value of a sum of C, M, Y, and K values of each pixel in image data corresponding to each page.

9. An image processing method for controlling a fixing temperature of a fixing device that fixes a formed image, the image processing method comprising:

controlling a fixing temperature for the (N+1)th page, based on a change amount between a toner amount of an N-th page, where N is a natural number, and a toner amount of an (N+1)th page in a print job having a plurality of pages, and a toner amount of an (N+2)th page in the print job; and controlling the toner amount of the (N+1)th page to be less than or equal to a toner amount which can be fixed at the controlled fixing temperature.

10. A non-transitory computer-readable storage medium storing a program that causes a computer to perform a method comprising:

controlling a fixing temperature for the (N+1)th page, based on a change amount between a toner amount of an N-th page, where N is a natural number, and a toner amount of an (N+1)th page in a print job having a plurality of pages, and a toner amount of an (N+2)th page in the print job; and controlling the toner amount of the (N+1)th page to be less than or equal to a toner amount which can be fixed at the controlled fixing temperature.

* * * * *